US005080524A

United States Patent [19]

Lee

[11] Patent Number: 5,080,524

[45] Date of Patent: Jan. 14, 1992

[54] ASPHALT ROAD RESURFACING MACHINE

[76] Inventor: Chin-Po Lee, No. 370, Chung Chen Rd., Jen Te Shiang, Tainan, Taiwan, Taiwan

[21] Appl. No.: 431,125

[22] Filed: Nov. 3, 1989

[51] Int. Cl.[5] ..... E01C 7/06

[52] U.S. Cl. ..... 404/90; 404/91; 404/95

[58] Field of Search ..... 404/95, 77, 79, 91, 404/90; 299/39

[56] References Cited

U.S. PATENT DOCUMENTS

| | | | |
|---|---|---|---|
| 2,093,766 | 9/1937 | Rich | 404/90 |
| 2,394,017 | 2/1946 | Seaman | 404/95 |
| 2,751,205 | 6/1956 | Petersen | 404/90 |
| 3,055,280 | 9/1962 | Neville | 404/95 |
| 3,970,404 | 7/1976 | Benedetti | 404/90 |
| 4,124,325 | 11/1978 | Cutler | 404/90 |
| 4,793,730 | 12/1988 | Butch | 404/79 |

*Primary Examiner*—Terry Lee Melius

[57] ABSTRACT

An asphalt road resurfacing machine includes a heater to soften asphalt pavement by heat, a plurality of scraper assemblies to excavate asphalt pavement, knock excavated asphalt pavement to pieces and mix the pieces evenly, a shaving device to shave the mixed pieces on the road, and a roller to crush and smooth the excavated asphalt pavement to a renovated condition.

1 Claim, 3 Drawing Sheets

ASPHALT ROAD RESURFACING MACHINE

BACKGROUND OF THE INVENTION

Asphalt concrete is commonly used in road construction. In an asphalt road construction, asphalt cement and gravel are mixed and paved on a road and then pressed tight by a road roller. However, an asphalt road tends to become deformed and aged, due to exposure to the weather, to affect driving safety. Therefore, an asphalt road must be regularly maintained and resurfaced. Drawbacks of the conventional method in resurfacing an asphalt road may include:

1. It is expensive to resurface an asphalt road, because it consumes much time, man-power and material consuming:

2. It is difficult to handle, because the old and waste asphalt pavement must be removed;

3. It obstructs traffic flow, because various road construction equipments and accessories are used an asphalt road must be blocked up when the asphalt road is to be resurfaced.

It is therefore, the main object of the present invention to provide such an asphalt road resurfacing machine which can efficiently excavate and renovate an asphalt pavement through a continuous operation to minimize manpower, time and material consumption.

Another object of the present invention is to provide such an asphalt road resurfacing machine which is practical in use to efficiently excavate and renovate an asphalt road without blocking up the road.

DETAILED DESCRIPTION OF THE PREFERRED EMBODIMENT

Figure 1:
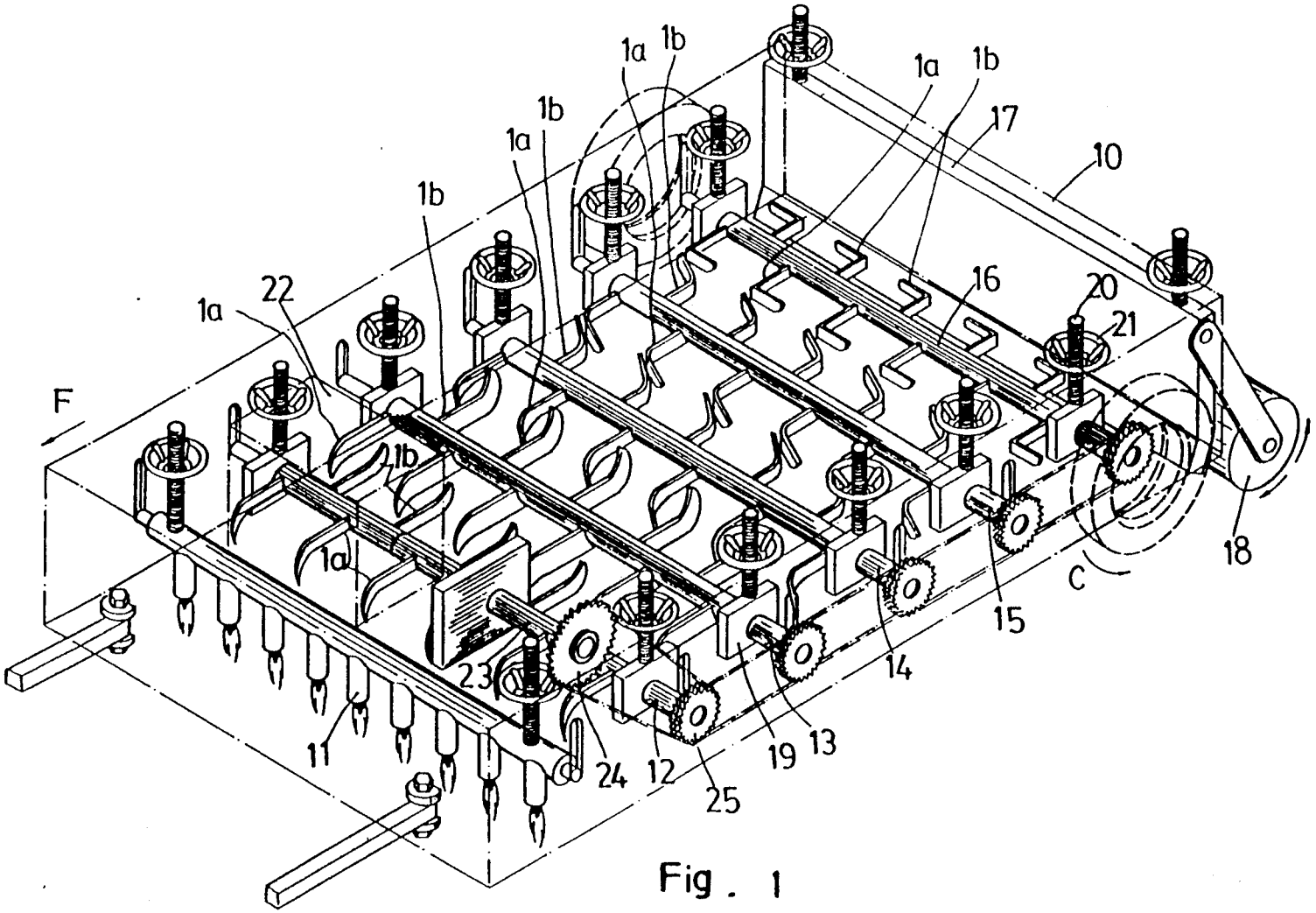
FIG. 1 is a perspective view of an asphalt road resurfacing machine embodying the present invention.
Figure 2:
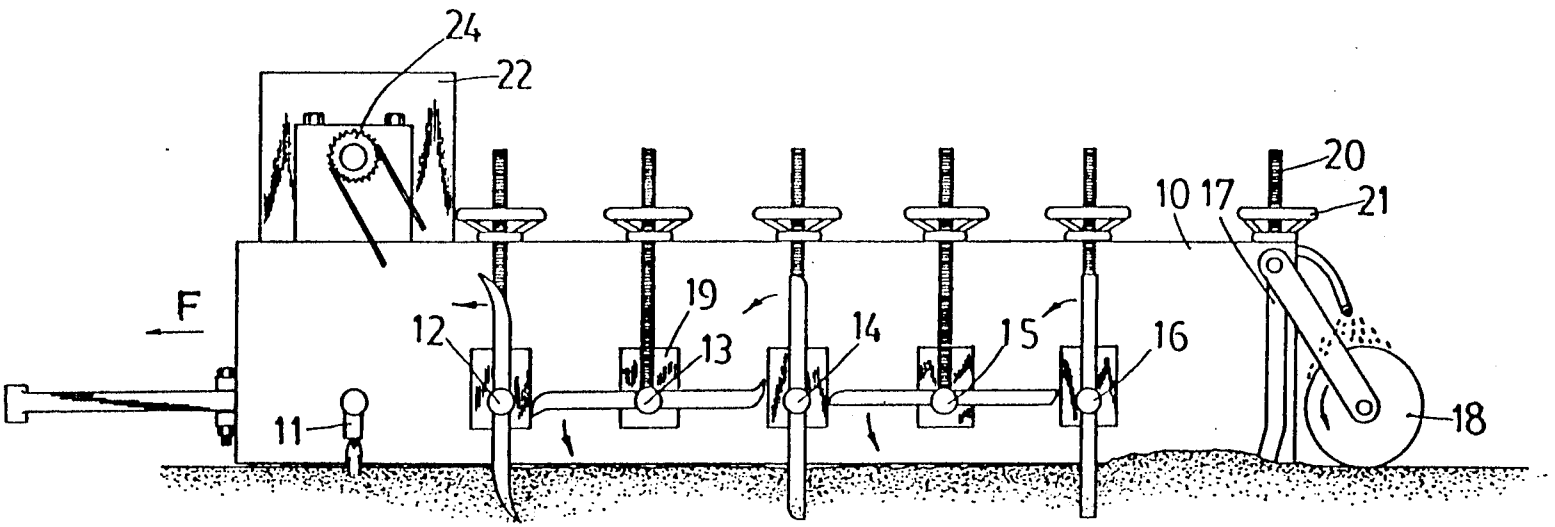
FIG. 2 is a sectional view illustrating the operation of the present invention.
Figure 3:
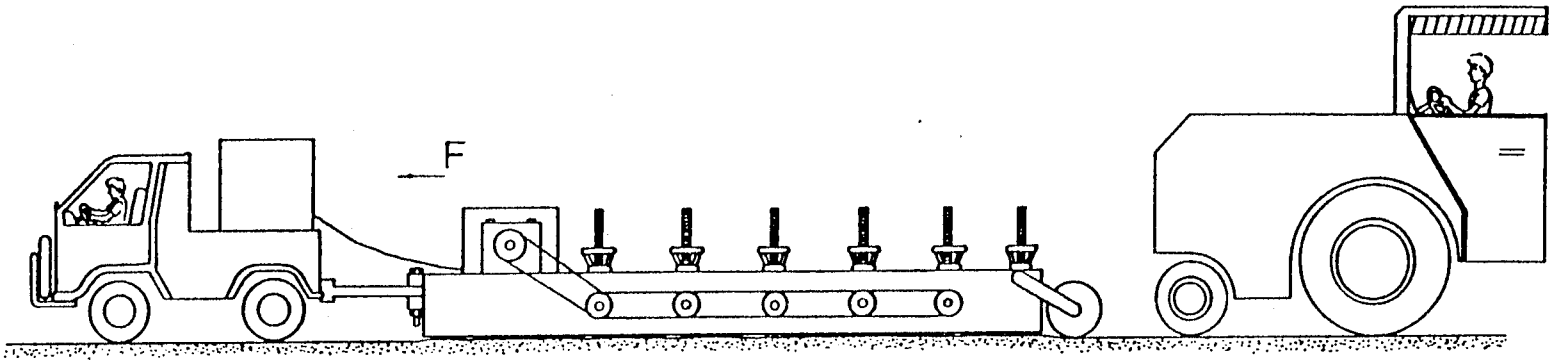
FIG. 3 is a schematic drawing illustrating that an asphalt road resurfacing machine of the present invention is carried by a tractor to renovate an asphalt road.

Turning now to the annexed drawings in detail, therein illustrated is an asphalt road resurfacing machine embodying the present invention and generally comprised of a housing 10 having set therein from the front to the back in proper sequence a heater 11 which softens asphalt pavement by heat and keeps the housing 10 warm, a first and a second scraper assemblies 12 and 13 having slightly curved cutting tools mounted thereon for excavating softened asphalt pavement, a third and a fourth scraper assemblies 14 and 15 having relatively more curved tools mounted thereon for smashing and mixing the excavated segments of asphalt pavement to pieces, a fifth scraper assembly 16 having right angular tools mounted thereon for additionally mixing the asphalt pieces, a shaving device 17 for shaving the surface of the excavated asphalt pavement. According to the present invention, a plurality of scraper assemblies are provided as shown in FIG. 1 in which each scraper assembly includes an axle rotatably mounted on the housing 10 having two rows of a plurality of cutting tools 1*a*, 1*b* juxtapositionally mounted on a first side of the axle of the scraper assembly and on a second side of the axle opposite to the first side of the axle with a first-row cutting tools 1*a* longitudinally evenly secured to the first side of the axle and a second-row cutting tools 1*b* longitudinally evenly secured to the second side of the axle opposite to the first-row cutting tools 1*a*.

Each first-row cutting tools 1*a* is projectively interposed between two second-row cutting tools 1*b*. Each cutting tool of a first scraper assembly such as numerals 12, 13 is curved or bent counterclockwise about a longitudinal axis of the axle rotatably mounted on the housing 10 corresponding to a counter-clockwise rotating direction R of a pair of wheels mounted on the housing 10 when frontwardly driving the housing 10 and the road resurfacing machine.

Each first-row cutting tool of a second scraper assembly such as numerals 14, 15 is curved or bent leftwardly towards a left portion of the housing based on a frontward driving direction of the housing 10 and the road resurfacing machine, whereas each second-row cutting tool of the second scraper assembly is curved or bent rightwardly towards a right portion of the housing 10 opposite to a bending direction of the first-row cutting tools.

A rearmost scraper assembly 16 formed on a rear portion of the housing 10 includes each first-row cutting tool of the rearmost scraper assembly bent leftwardly at a right angle to be generally parallel to the longitudinal axis of the axle based on a frontward driving direction F of the housing 10 and the road resurfacing machine, and each second-row cutting tool bent rightwardly at a right angle to be generally parallel to the longitudinal axis of the axle opposite to a bending direction of the first-row cutting tool of the rearmost scraper assembly. Further, a roller 18 is attached to the housing 10 at the back side for smoothing the road. The road can then be smoothed further by a road roller to become in a renovated condition.

According to the present invention, the scraper assemblies 12, 13, 14, 15 and 16 each is respectively suspended by a pair of rectangular blocks 19 fixedly set inside the housing 10 at both sides. A screw rod 20 which is driven by a hand-wheel 21 is mounted on each rectangular block 19 and engaged with one end of an scraper assembly 12, 13, 14, 15 or 16. Through the control of a hand-wheel 21, the level positioning of an scraper assembly 12, 13, 14, 15 or 16 can be well adjusted according to the condition of the asphalt pavement to renovate. The power transmission of the present invention is made through a gear box 22 and chain wheel driving mechanism. According to the present invention, the scraper assemblies 12, 13, 14, 15 and 16 each includes a chain wheel set comprised of two chain wheels and all the chain wheel sets of the scraper assemblies are connected by a respective chain between each two assemblies. The gear box 22 comprises a spindle 23 having a chain wheel 24 mounted thereon at the front end connected to the chain wheel set 25 of the first scraper assembly 12 via a chain to further carry the second, third, fourth and fifth scraper assemblies 13, 14, 15 and 16 through respective chain wheel sets and chains. Further, a water sprayer may be mounted on the housing 10 at the back side above the roller 18 to smooth the roller 18, and a pair of wheels are mounted on the housing bilaterally at the bottom rear end, as indicated in the dotted lines of FIG. 1, permitting carrying of the present invention to a job-site. Upon arrival at job-site, the wheels are removed from the housing 10 permitting the present invention be carried by a tractor to start asphalt pavement excavating and resurfacing process.

When in operation, four operators will be sufficient to perform asphalt pavement excavating and resurfacing process through the present invention, i.e. one tractor driver to drive a tractor to carry the present invention, one operator to adjust the present invention, one road roller driver, and one road grader driver.

I claim:

1. An asphalt road resurfacing machine comprising:

a housing having a heater provided in a front portion of said housing to soften asphalt pavement by heat and a pair of wheels rotatably mounted in a rear bottom portion of said housing;

a plurality of scraper assemblies subsequently formed in said housing following said heater to excavate the asphalt pavement, knock and mix excavated asphalt pavement homogeneously, each scraper assembly having an axle rotatably mounted on said housing;

a shaving device formed on a rear portion of said housing following said scraper assemblies to shave mixed excavated asphalt pavement; and a roller secured to a rear portion of said housing to crush and smooth the asphalt pavement for renewing a road surface, the improvement which comprises:

each said scraper assembly including two rows of a plurality of cutting tools juxtapositionally mounted on two opposite sides of the axle of the scraper assembly, having a first-row cutting tools longitudinally evenly secured to a first side of said axle and a second-row cutting tools longitudinally evenly secured to a second side of said axle opposite to the first-row cutting tools, each first-row cutting tool projectively interposed between two second-row cutting tools, at least a first scraper assembly formed in a first portion of said housing having each cutting tool curved counter clockwise about a longitudinal axis of the axle rotatably mounted on said housing corresponding to a counter-clockwise rotating direction of said pair of wheels mounted on said housing when frontwardly driving said housing and said road resurfacing machine, at least a second scraper assembly formed in a middle portion of said housing having each first-row cutting tool of said second scraper assembly bent leftwardly towards a left portion of said housing based on a frontward driving direction of said housing and each second-row cutting tool of said second scraper assembly bent rightwardly towards a right portion of said housing opposite to a bending direction of said first-row cutting tool of said second scraper assembly, and a rearmost scraper assembly formed on a rear portion of said housing having each first-row cutting tool of the rearmost scraper assembly bent leftwardly at a right angle to be generally parallel to the longitudinal axis of the axle based on a frontward driving direction of the housing and each second-row cutting tool bent rightwardly at a right angle to be parallel to the longitudinal axis of the axle opposite to a bending direction of the first-row cutting tool of the rearmost scraper assembly.

* * * * *